US006755499B2

(12) United States Patent
Castano et al.

(10) Patent No.: US 6,755,499 B2
(45) Date of Patent: Jun. 29, 2004

(54) PRINTER DEVICE ALIGNMENT METHOD AND APPARATUS

(75) Inventors: Jorge Castano, Barcelona (ES); David Toussaint, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/113,856

(22) Filed: Mar. 28, 2002

(65) Prior Publication Data

US 2002/0181986 A1 Dec. 5, 2002

(30) Foreign Application Priority Data

Mar. 30, 2001 (EP) ..... 01108128
Sep. 4, 2001 (EP) ..... 01121159

(51) Int. Cl.[7] ..... B41J 29/393; B41J 7/18
(52) U.S. Cl. ..... 347/19; 400/74
(58) Field of Search ..... 347/19, 14, 16, 347/23, 5, 37, 43, 75, 40, 8–12; 400/74; 356/399–401; 250/548, 568

(56) References Cited

U.S. PATENT DOCUMENTS

| | | | | |
|---|---|---|---|---|
| 4,550,322 A | 10/1985 | Tamai | ..... | 346/81 |
| 4,990,932 A | 2/1991 | Houston | ..... | 346/81 |
| 5,796,414 A | 8/1998 | Sievert et al. | ..... | 347/19 |
| 5,835,108 A | 11/1998 | Beauchamp et al. | ..... | 347/19 |
| 5,975,674 A | 11/1999 | Beauchamp et al. | ..... | 347/19 |

FOREIGN PATENT DOCUMENTS

| | | |
|---|---|---|
| EP | 0744295 A1 | 11/1996 |
| EP | 0863004 A2 | 9/1998 |
| EP | 0867298 A2 | 9/1998 |
| EP | 0895869 A2 | 2/1999 |
| EP | 1027987 A1 | 8/2000 |
| EP | 1033251 A1 | 9/2000 |
| WO | 89/02826 | 4/1989 |

*Primary Examiner*—Stephen D. Meier
*Assistant Examiner*—Charles Stewart, Jr.

(57) ABSTRACT

A method of determining a registration offset in a hard copy apparatus, the apparatus comprising a pen arranged to mark a print medium and a sensor arranged to detect marks on the medium along a sensor path, the method comprising the steps of: marking a alignment pattern on the medium, the pattern being at least partially located along the sensor path; detecting the position along the sensor path of a portion of the pattern; and, determining a distance by which the pattern is offset from the sensor path in a direction substantially perpendicular to the sensor path, the pattern being configured such that the detected position is indicative of the offset distance.

21 Claims, 13 Drawing Sheets

PRINTER DEVICE ALIGNMENT METHOD AND APPARATUS

This application is related to U.S. patent application Ser. No. 09/627,509, filed Jul. 28, 2000, entitled "Techniques for Measuring the Position of Marks on Media and for Aligning Inkjet Devices", which is hereby incorporated by reference and to U.S. application Ser. No. 08/551,022, filed Oct. 31, 1995, entitled "Optical Path Optimization for Light Transmission and Reflection in a Carriage-Mounted Inkjet Printer Sensor", which is also hereby incorporated by reference.

Additionally, this application is related to U.S. Pat. No. 5,835,108, entitled "Calibration Technique for Misdirected Inkjet Printhead Nozzles", the disclosure of which is incorporated herein by reference.

FIELD OF THE INVENTION

The present invention relates to printer devices, and particularly, although not exclusively, to a method and apparatus for determining and correcting misalignments between printheads in ink jet devices.

BACKGROUND TO THE INVENTION

It is known to produce paper copies, also known as "hard" copies of files stored on a host device, e.g. a computer using a printer device. The print media onto which files may be printed includes paper and clear acetates for use in lectures, seminars and the like.

Referring to FIG. 1, there is illustrated a conventional host device 1, in this case a personal computer, linked to a printer device 2 via a cable 3. Amongst the known methods for printing text or graphics and the like onto a print media such as paper it is known to build up an image on the paper by spraying drops of ink from a plurality of nozzles.

Referring to FIG. 2, there is illustrated schematically part of a prior art printer device comprising an array of printer nozzles 4 arranged into parallel rows. The unit comprising the arrangement of printer nozzles is known herein as a printhead. In a conventional printer of the type described herein, the printhead 5 is constrained to move in a direction 6 with respect to the print media 7 e.g. a sheet of A4 paper. In addition, the print media 7 is also constrained to move in a further direction 8. Preferably, direction 6 is orthogonal to direction 8.

During a normal print operation, printhead 5 is moved into a first position with respect to the print media 7 and a plurality of ink drops 9*a*, 9*b* are sprayed from a number of printer nozzles 4 contained within printhead 5. This process is also known as a print operation. After the completion of a print operation the printhead 5 is moved in a direction 6 to a second position and another print operation is performed. In a like manner, the printhead 5 is repeatedly moved in a direction 6 across the print media 7 and a print operation performed after each such movement of the printhead 5. In practice, modern printers of this type are arranged to carry out such print operations while the printhead is in motion, thus obviating the need to move the printhead discrete distances between print operations. When the printhead 5 reaches an edge of the print media 7, the print media is moved a short distance in a direction 8, parallel to a main length of the print media 7, and further print operations are performed. By repetition of this process, a complete printed page may be produced in an incremental manner.

Since the advent of colour printing, printers with more than one printhead are typically used. Generally, four printheads are used, each storing and printing a different colour; for example: cyan; magenta; yellow; and black. The inks from the four printheads are mixed on the print media to obtain any other particular colour.

However, full colour printing requires that the inks from the individual printheads are accurately applied to the print media.

In order that this may be achieved, precise alignment of the various printheads is required. The mechanical misalignment of a printhead may result in an offset in the positioning of ink drops on the print media. Such offsets may occur in the X direction (in the media advance/media axis) or the Y direction (in the carriage/scan axis). Additionally, angular offsets may also arise. If each printhead in a printer is not sufficiently accurately aligned with the remaining printheads of the printer, a misregistration between the images formed by the different coloured ink drops on the print media may result. This may cause too much ink to be deposited in some areas and too little ink to be deposited in others. This often gives rise "grainy" appearance in the printed image. This type of print error is often particularly noticeable to the viewer. Consequently, such misregistrations are generally unacceptable, with colour printing typically requiring image registration accuracy from each of the printheads of $1/2400$ inch.

Various systems have been devised to address misregistration. In particular, systems have been devised in order to ensure that offsets in the X direction (media axis) are reduced to acceptable levels. One such known system employs a unitary colour printhead, which contains the nozzles of each ink colour: cyan; magenta; and yellow. Thus, the nozzles of each ink colour may be accurately aligned with those of the other colours on manufacture. Thus, when the printhead is mounted in the print carriage of a printer, the positions of the nozzles of each ink colour are constrained with respect to each other. In this way, the operator need only ensure that the colour printhead is correctly aligned with the black ink printhead.

In this system, this is achieved by printing two overlying alignment patches on the print medium, one with the black ink printhead and the other with the colour printhead. Each alignment patch consists of a series of parallel lines. However, the spacing of the lines of the two alignment patches is slightly different, thus giving rise to an interference pattern. When the alignment patches have been printed, the operator manually inspects them to determine the position in the overlying alignment patches of the maximum or minimum ink density. From this information, the relative offset between the two printheads in the media feed direction may be determined.

Once this determination has been made, the processor of the printer compensates for any offset in the media feed direction between printheads by avoiding using those nozzles in each printhead that extend in the media feed direction beyond the nozzles of the other printhead. The processor of the printer also resets the "logical zero" in terms of the nozzles' numbering in each printhead. That is to say that the nozzles which are to be used in each printhead are re-numbered, where necessary, such that the nozzles in each printhead which correspond in terms of their position along the media feed direction are allocated the same number, in order to ensure correct registration between the images printed by the different printheads. In this manner, the print output of the two printheads may be aligned at the expense of a slightly reduced number of usable nozzles.

This technique suffers from the disadvantage that it is relatively slow, being non-automated and reliant upon an operator. Furthermore, the process is less suitable for use in printers having more than two printheads, due to the increased difficulty of determining the relative offsets for a greater number of printheads.

A second type of known system is generally used on large format ink jet printers, which employ separate printheads for each ink colour. In order to ensure that no misregistration occurs between the images formed by the different coloured ink drops on the print medium, an alignment routine is performed.

In this routine, alignment patches are printed across the sheet of print media with each printhead so that they are approximately aligned along the scan axis; i.e. in a direction perpendicular to the media feed direction. The positions of the alignment patches in the media feed direction are then measured using an optical scanner, often referred to as a line scanner, which is mounted on the printer carriage. This is achieved for each alignment patch by positioning the line scanner at the appropriate point along the scan axis so as to be able to detect the alignment patch and then feeding the print media backwards (i.e. in a reverse feed direction) so that the position of the patch on the media in the media feed direction may be determined. The line scanner is then positioned at the appropriate point along the scan axis to detect the next alignment patch and the print media is fed forwards once again in readiness for determining the position of the next patch in the media feed direction. Once the position of each alignment patch in the media feed direction has be determined in this manner, the relative offsets in the media feed direction between the individual printheads are calculated.

The print output of the different printheads are then aligned in the media feed direction in the same manner as described above with respect to the first type of prior art system; i.e. by avoiding using those nozzles in each printhead that extend in the media feed direction beyond the nozzles of the other printheads and by resetting the "logical zero" in terms of the nozzles' numbering.

Although this system functions satisfactorily, the process which it employs is relatively slow, since the print media must be fed backwards and then forwards again in order to measure the position of each of the alignment patches. As the trend for increased numbers of printheads in a printer continues, the duration of such an alignment procedure is proportionally increased. Additionally, this system suffers from a further problem in that it can only be used with printer mechanisms that are capable of feeding the print media in both a forwards and a reverse feed direction. Thus, this technique is generally not applicable to printers in which the reverse feed direction of the media feed motor is used to perform other functions, such as powering a duplexing mechanism. Such printers include many high production, small format printers.

It would therefore be desirable to provide a system and method for determining a relative offset in the media advance direction between the printheads of a printer, which overcomes one or more of the disadvantages associated with the prior art.

SUMMARY OF THE INVENTION

According to a first aspect of the present invention there is provided a method of determining a registration offset in a hard copy apparatus, comprising the steps of: marking a alignment pattern on a print medium with a first pen; traversing the pattern in a first direction with a sensor and measuring the position of a portion of the pattern in the first direction; and, determining the offset of the pattern in a second direction, the pattern being configured such that the measured position in the first direction is indicative of a registration offset in a second direction.

By using an alignment pattern that is configured such that a measurable distance associated with the pattern in a first direction, for example along the scan axis of a printer device, allows the placement of the pattern in a second direction, for example along the media feed direction of the printer device, to be determined several advantages are realised.

Firstly, the alignment pattern may be printed and then scanned in the same direction, for example, along the scan axis direction of a printer. Thus, the two processes may be implemented without having to feed the print media, or having to scan the alignment pattern in a direction different from that in which the alignment pattern was printed. Thus, complex scanning arrangements may be avoided.

Moreover, this makes it possible to avoid the necessity associated with some prior art methods of requiring the alignment patterns, once printed, to be moved backwards and forwards under an optical scanner in order to establish their position along the media feed axis. As a consequence, the process by which the printheads offsets in the media feed direction may be achieved according to the present invention is comparatively rapid. This is because one pass of an optical scanner across the print medium may be sufficient to measure offsets of even a large number of printheads in the media feed direction.

Preferably, the alignment pattern of the present invention comprises two lines, one arranged parallel to the media feed axis and a second arranged at 45 degrees to the first. By scanning a narrow path across the scan axis of the media, intersecting both lines, the distance between the two points in the scan path intersected by the two lines may be measured. Due to the fact that the two lines of the alignment pattern are arranged at 45 degrees to each other, the measured distance will be equal to the perpendicular distance from the scan path to the point at which the two lines intersect. Thus, a change in the offset of a printhead in the media feed axis will cause the position of the alignment pattern, including both lines, to be offset relative to the scan path. Therefore, the distance between the two points in the scan path intersected by the two lines will change in proportion to the offset. Thus, by measuring the distance between the point in each line intersected by the scan path, the offset of the printhead in the in the media feed axis may be determined.

Preferably, the method also includes the step of compensating the measured registration offset for any errors introduced into the measurement process by a non-constant pen-to-paper spacing in the region of the alignment pattern. According to a preferred embodiment of the present invention, this is achieved by additionally printing two or more reference patterns, with a further pen, in known positional relationships relative to the alignment pattern. The reference patterns are printed with a single printhead in order that no significant offset between the reference patterns exists in the media feed direction. The reference patterns are configured in a similar manner to the alignment pattern, in that a measured position or distance in the first direction is indicative of a registration offset in a second direction. By determining what difference, if any, lies between the respective positions of the reference patterns in the second direction, an estimation of the error introduced into the measurement process by a non-constant pen-to-paper spacing in the region of the reference patterns may be obtained. The error in the position of the alignment pattern may then be determined by interpolation.

Advantageously, this method also provides for a correction for any errors introduced into the offset measurement process that might be caused by skewing of the print media between the steps of printing and scanning the alignment pattern. Thus, this embodiment makes the invention highly suited to printer devices which have a scanner located at a different point on the media path to the printheads; for example downstream.

The present invention also extends to the corresponding apparatus for implementing the above method. Furthermore, the present invention also extends to a computer program, arranged to implement the method of the present invention.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which:

FIG. 8*b* illustrates the schematic plan view of the printheads shown in

FIG. 8*a*, showing the usable nozzles in each printhead once the offsets between individual printheads in the media advance direction have been determined using the method of the present invention;

DETAILED DESCRIPTION OF THE BEST MODE FOR CARRYING OUT THE INVENTION

There will now be described examples of the best mode contemplated by the inventors for carrying out the invention.

First Embodiment

System of the First Embodiment

A typical application for the invention is in a large format colour inkjet printer. Commonly assigned U.S. Pat. No. 5,835,108, entitled "Calibration technique for misdirected inkjet printhead nozzles", describes an exemplary system which can employ aspects of this invention and the entire contents of which are incorporated herein by reference.

Figure 1:
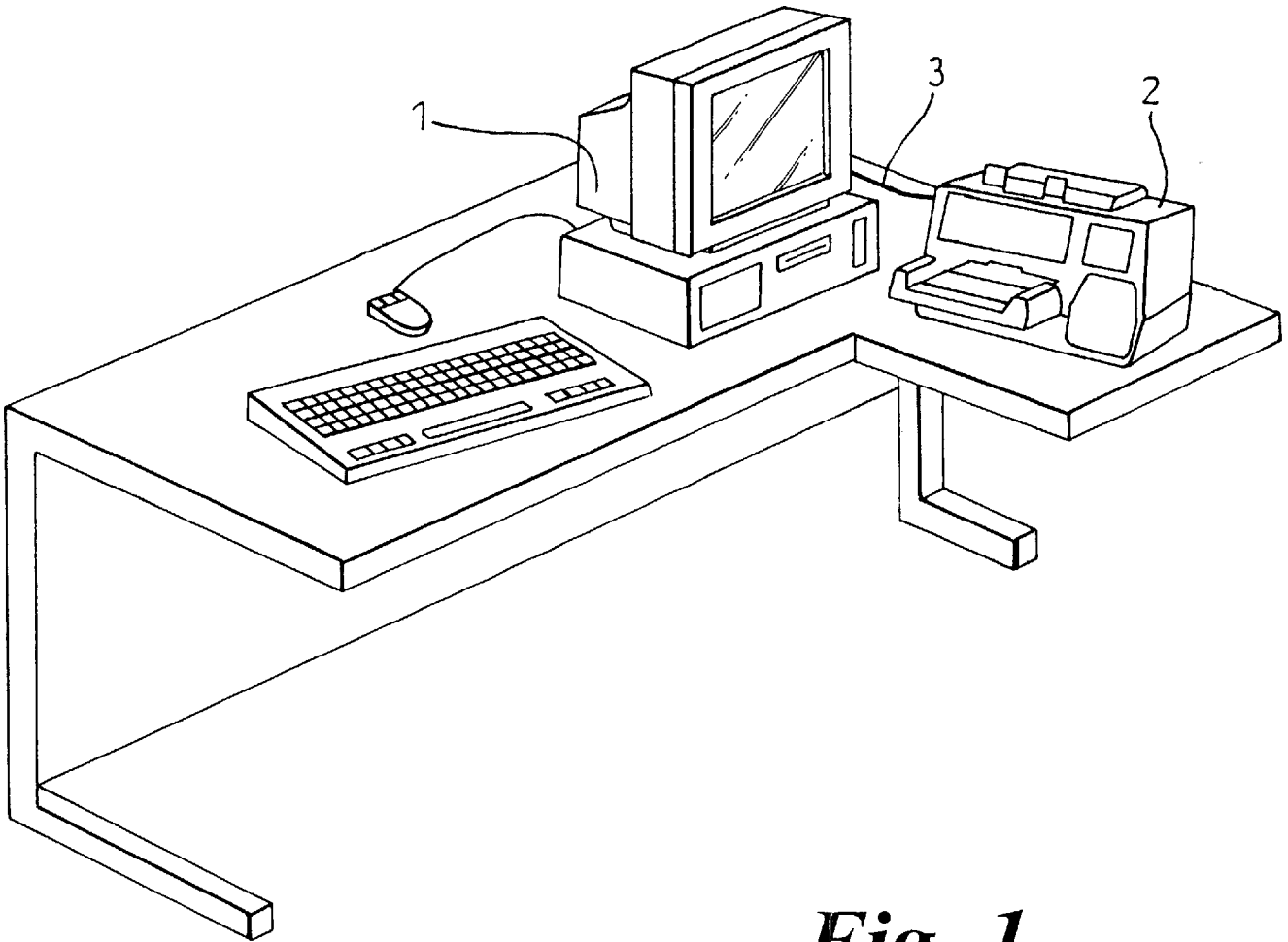
Fig. 1 (PRIOR ART)
FIG. 1 illustrates a prior art printing system incorporating a personal computer linked to a printer.
Figure 2:
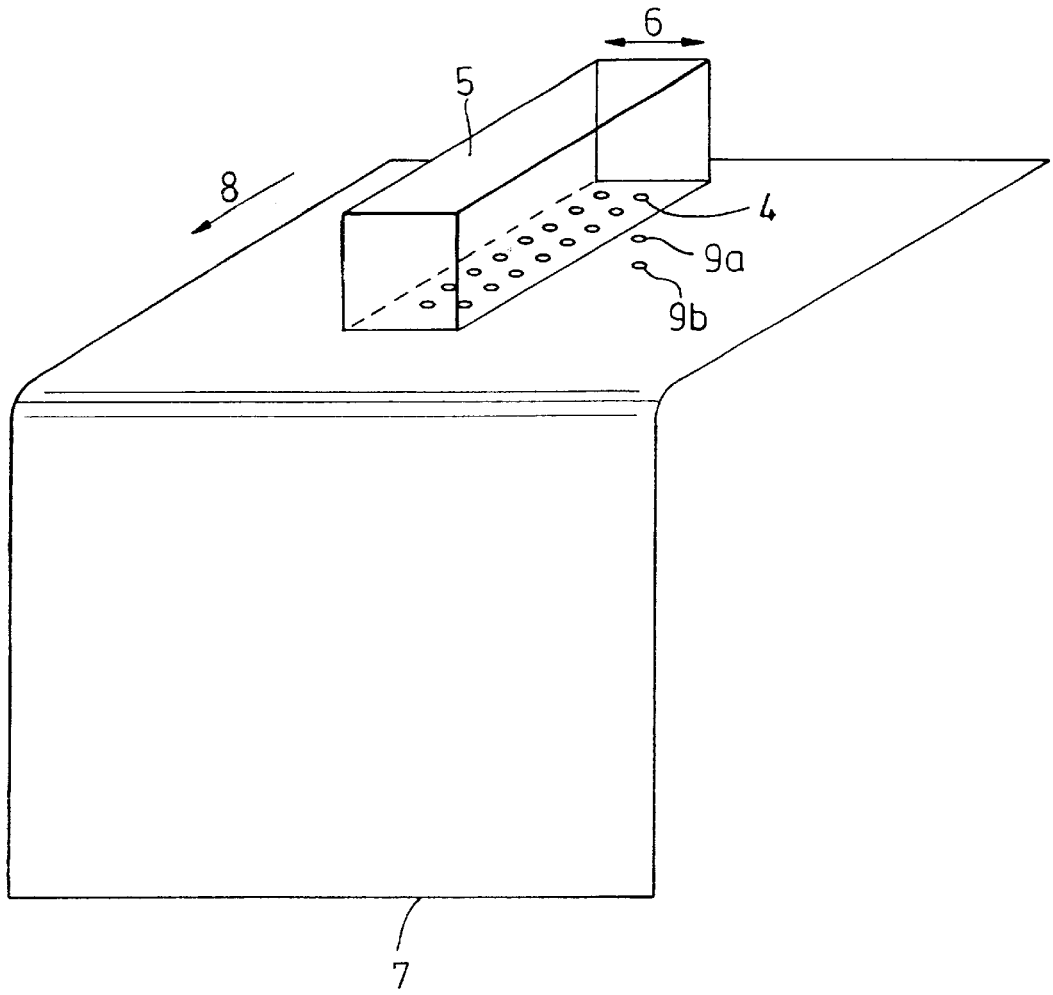
Fig. 2 (PRIOR ART)
FIG. 2 illustrates schematically part of a prior art printhead in relation to the print media on which it prints.
Figure 3:
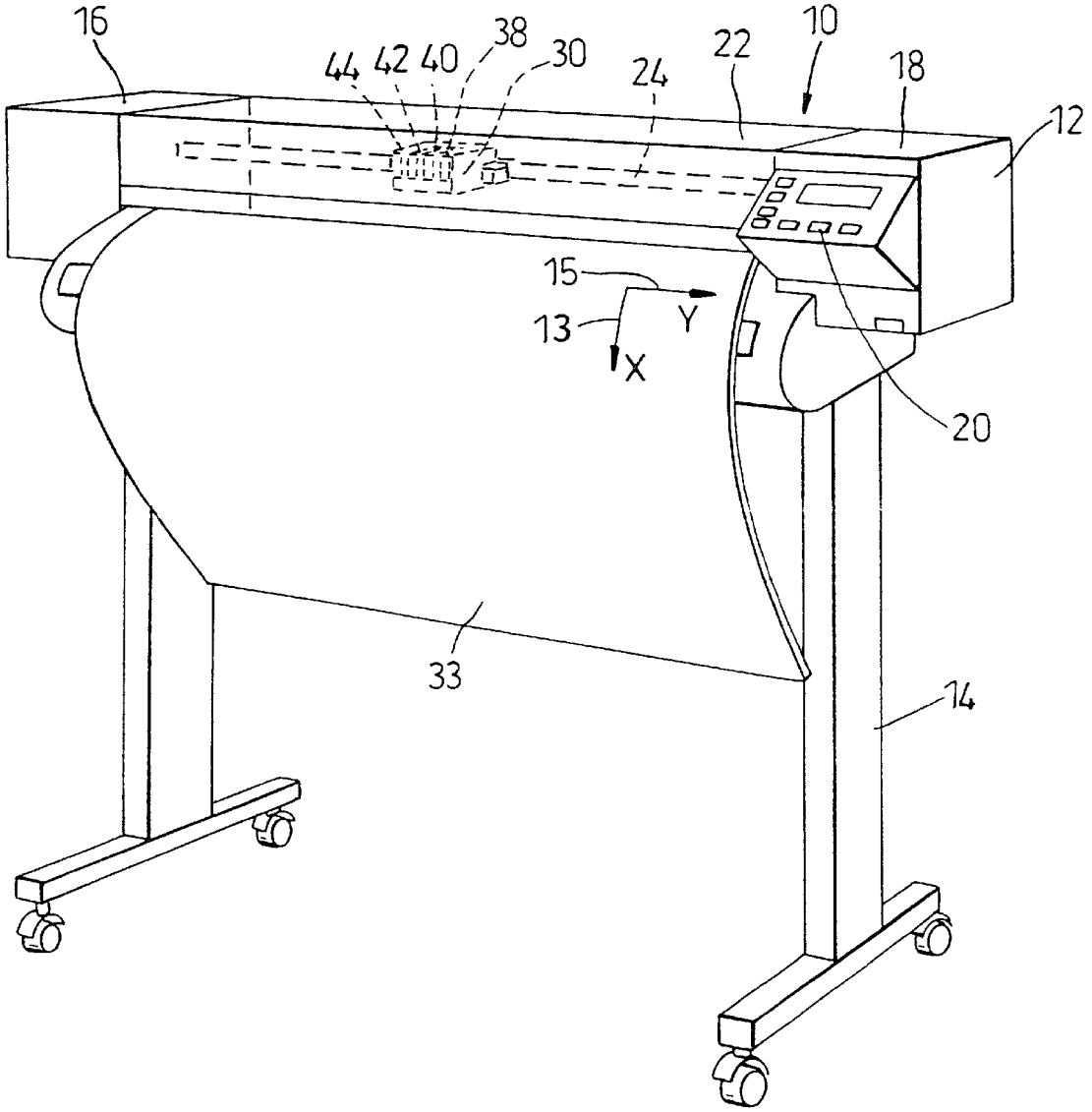
FIG. 3 shows a perspective view of a large format inkjet printer incorporating the features of a first embodiment of the present invention.

Referring now to FIG. 3, the system of the present embodiment will now be described. The figure shows a perspective view of an inkjet printer 10 having a housing 12 mounted on a stand 14. The housing has left and right drive mechanism enclosures 16 and 18. A control panel 20 is mounted on the right enclosure 18. A print medium 33 such as paper is positioned along a vertical or media axis by a media axis drive mechanism (shown in FIG. 5). As used herein, the media axis is called the X-axis denoted as 13, and the scan axis is called the Y-axis denoted as 15.

A carriage assembly 30, illustrated in phantom under a cover 22, is adapted for reciprocal motion along a carriage bar 24 (i.e. along the scan axis), which is also shown in phantom and is arranged to support and position the four inkjet print cartridges 38, 40, 42, and 44 (shown more clearly in FIG. 4) that store ink of different colours, e.g., black, magenta, cyan and yellow ink, respectively. The carriage assembly also holds the circuitry required for interface to the ink firing circuits in the print cartridges. As the carriage assembly translates relative to the medium 33 along the X and Y-axes, selected nozzles in the inkjet print cartridges are activated and ink is applied to the medium 33. The colours from the three colour cartridges are mixed to obtain any other particular colour.

Figure 4:
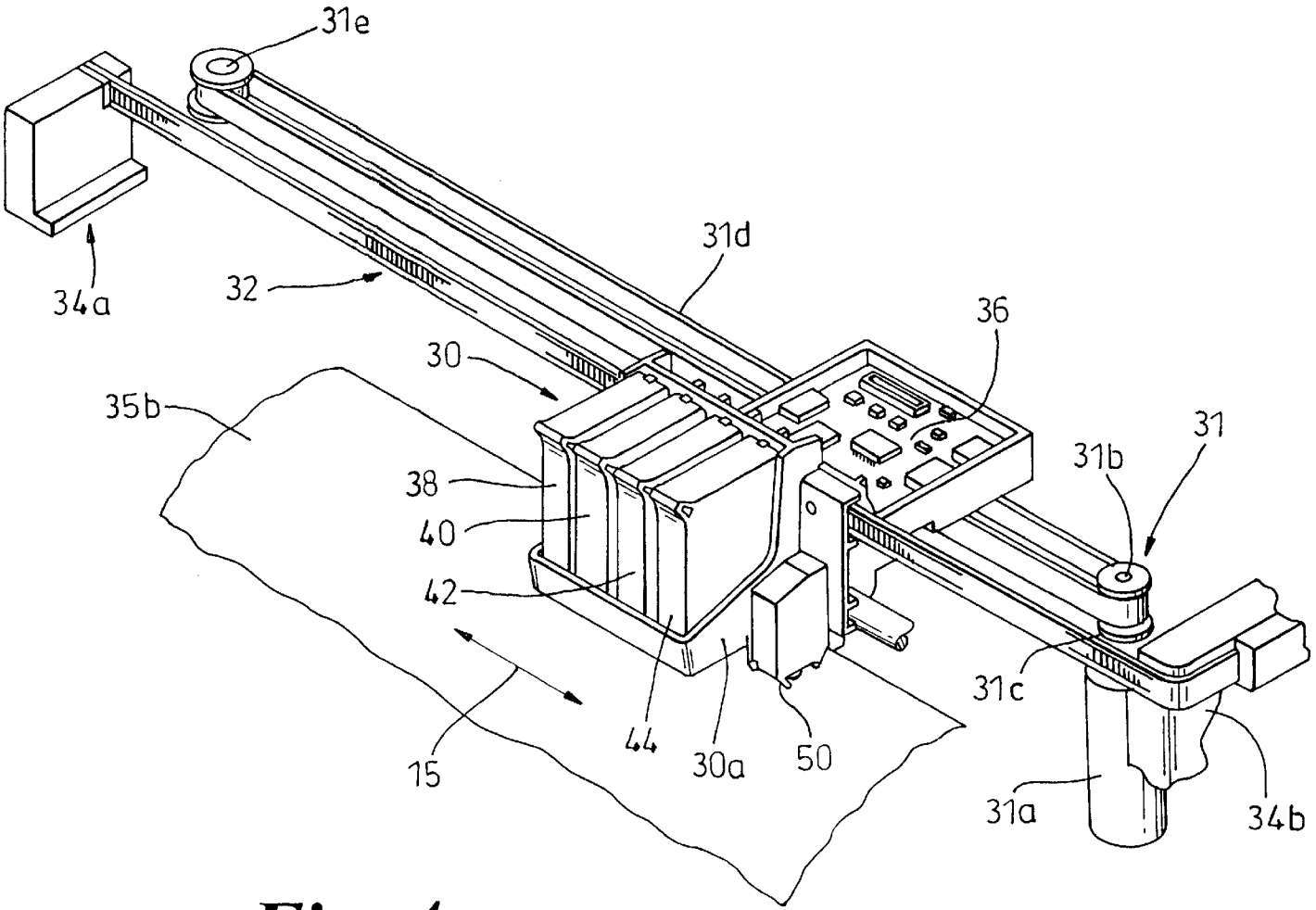
FIG. 4 shows a schematic perspective view of the carriage portion of the printer of FIG. 3 showing a carriage-mounted optical sensor.
Figure 6:
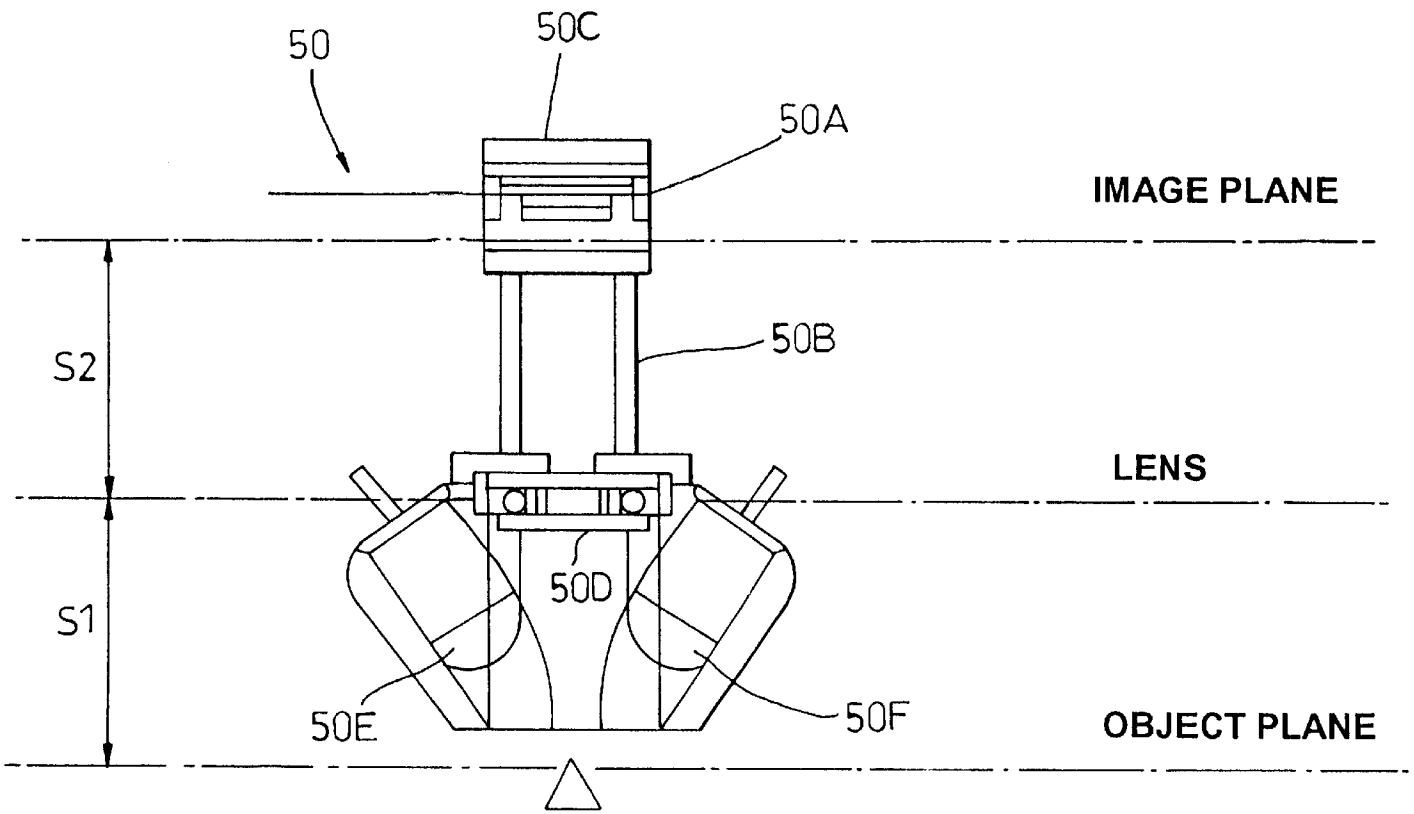
FIG. 6 shows a view of the components of the optical sensor unit of the printer of FIG. 3.

The position of the carriage assembly 30 along the scan axis is determined by a carriage positioning mechanism 31 with respect to an encoder strip 32, as are illustrated in FIG. 4. FIG. 4 is a perspective view of the carriage positioning mechanism 31 and the encoder strip 32 together with the carriage assembly 30, which is shown supporting the four print cartridges 38, 40, 42, and 44, and positioned above the media roller 35*b*, of which a partial view is shown. As can be seen from the figure, an optical sensor 50, which is described below with respect to FIGS. 6 and 7, is connected to the carriage assembly 30.

The carriage positioning mechanism 31 includes a carriage position motor 31*a* which has a drive shaft and a drive roller 31*b* and 31*c*, respectively, and which drives a belt 31*d*. The belt is secured by idler 31*e* and is attached to the carriage 30. In this manner, the position of the carriage assembly 30 may be moved in the Y-axis 15 along the carriage bar 24. The carriage assembly 30 may be moved in either a positive or a negative direction, as is indicated by the arrow 15 in the figure, in dependence upon the direction of rotation of the motor 31*a*.

The position of the carriage assembly 30 in the scan axis is determined precisely using the encoder strip 32. The encoder strip 32 is secured by a first stanchion 34*a* at one end and a second stanchion 34*b* at the other end. An optical encoder strip reader (not shown) is disposed on the carriage assembly 30 and provides carriage position signals that are utilized to determine the position of the carriage assembly 30 in the Y-axis 15.

Figure 5:
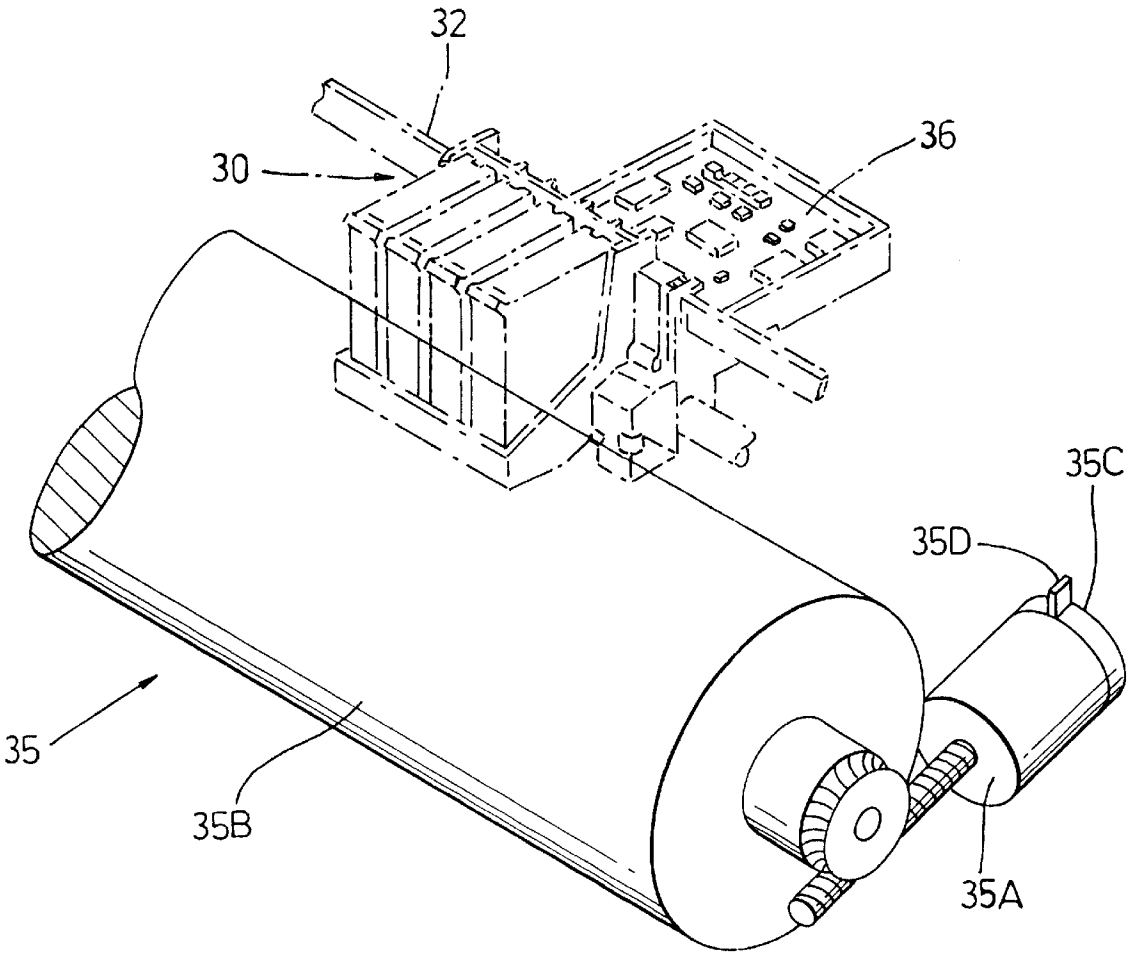
FIG. 5 shows a schematic perspective view of the media positioning system of the printer of FIG. 3.

FIG. 5 is a perspective view of a simplified representation of the media positioning system 35 of the printer 10, in relation to the printer carriage assembly 30. The media positioning system 35 includes a motor 35*a*, which is normal to and drives the media roller 35*b*. The position of the media roller 35*b* is determined by a media position encoder 35*c* on the motor. An optical reader 35*d* senses the position of the encoder 35*c* and provides a plurality of output pulses, which indirectly determine the position of the roller 35*b* and, therefore, the position of the media 33 in the X-axis.

The media and carriage position information is provided to a processor on a circuit board 36 disposed on the carriage assembly 30 for use in connection with printhead alignment techniques of the present invention.

FIG. 6 illustrates the optical sensor unit 50 of the printer 10. The optical sensor 50 is arranged to sense marks or ink on the print media 33, which have been ejected by the printheads 38, 40, 42, 44. As has been stated above, the optical sensor 50 is mounted on the carriage assembly 30 and thus is free to sense marks on any portion of the print media 33 by moving the printer carriage 30 and/or the media 33 to selected locations along the X and Y-axes, respectively.

The specific sensor and method used in order to establish the position of a line or mark on the print media does not form part of the invention and any suitable, known sensor and method may be used for this purpose. However, for the purposes of clarity, a suitable optical sensor and method will now be briefly described. For a more complete description of such an optical sensor and its method of use, the reader is referred to U.S. patent application Ser. No. 09/627,509 filed Jul. 28, 2000, entitled "Techniques for measuring the posit marks on media and for aligning inkjet devices", which is assigned to the assignee of the present application, and is hereby incorporated by reference. Additional details of the function of a preferred optical sensor system and related printing system are disclosed in U.S. application Ser. No. 08/551,022 filed Oct. 31, 1995 entitled "Optical path optimization for light transmission and reflection in a carriage-mounted inkjet printer sensor", which is assigned to the assignee of the present application, and is hereby incorporated by reference.

FIG. 6 shows a more detailed view of the optical sensor unit 50 shown in FIG. 4. The optical sensor unit 50 includes: a photocell, or optical detector 50*a*; a holder 50*b*; a cover 50*c*; an optical element or lens 50*d*; and, a light source such as two LEDs 50*e*, 50*f*. The optical sensor unit 50 in this exemplary embodiment includes two LEDs, one green and one blue; the green LED being used to scan all of the patterns or marks except the patterns or marks used to obtain information from the yellow ink printhead.

A protective casing (shown in FIG. 4) that also acts as an ESD shield for sensor components is provided for attachment to the carriage. Also shown in the figure are the relative positions of the object plane and the image plane that are offset from the plane of the lens by distances S1 and S2, respectively.

The light from the light sources 50*e*, 50*f* illuminates the object, such as a printhead alignment pattern printed on print media 33. The image of the object is focussed by the optical element 50*d* on the image plane and is detected by the optical detector 50*a* in a conventional manner.

In operation, the optical sensor unit 50 is arranged to scan a "line" across the print medium 33 in the scan or Y-axis direction as the printer carriage assembly 30, to which the optical sensor unit 50 is mounted, is moved across the scan axis. Where the optical sensor unit 50 passes over areas of the print medium 33 with levels of reflectivity that differ from adjacent areas along the scanned line, the signal output by the optical detector 50*a* will vary in dependence upon the local changes in the detected levels of reflectivity. Such areas include marks or portions of alignment patterns printed on the print medium 33 by one of the four inkjet print cartridges 38, 40, 42, and 44. In this manner, changes in the output signal of the optical detector 50*a* can be used to determine the position of a mark on the print medium 30.

Figure 7A:
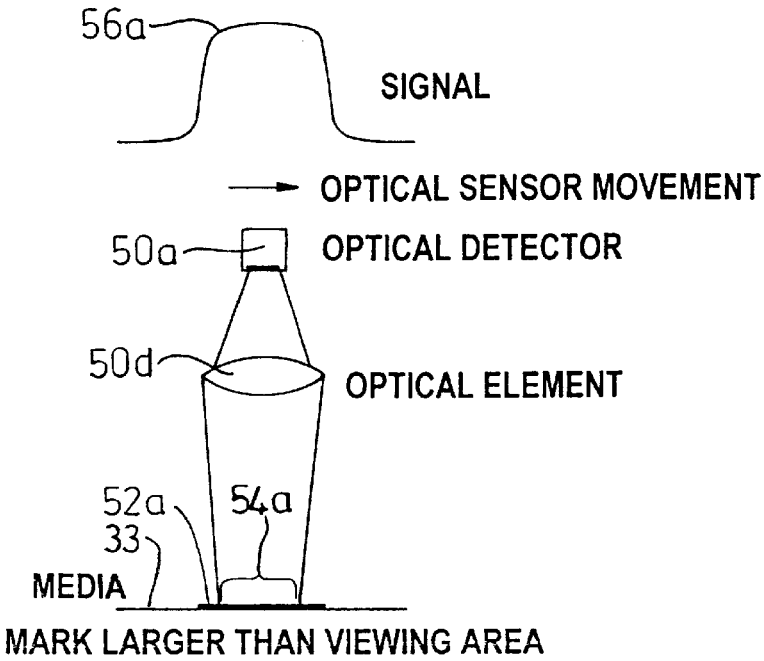
FIGS. 7*a* and 7*b* schematically illustrate the optical sensor of FIG. 6 located adjacent to a mark on a print medium, with FIG. 7*a* illustrating the case in which the size of the mark is larger than the field of view of the sensor and FIG. 7*b* illustrating the case in which the size of the mark is smaller than the field of view of the sensor.

This is illustrated in FIG. 7*a*. In the figure, the optical sensor unit 50 is illustrated at the point that it passes over a mark 52*a* as it traverses the scan axis (as indicated by the arrow in the figure).

The optical detector 50*a* has a photosensitive area or areas which produce electrical sensor signals 56*a* that follow the optical transfer function (OTF) of the optical system. This OTF is the response of the optical sensor to the light reflected from the media. The spatial response of the sensor is the mapping of the signal from the sensor in response to a point light source scanning along the viewing area of the optical system. The optical response can be defined mathematically as the "point spread function" (PSF), i.e. the response of the detector system to light from a point in space.

Figure 7B:
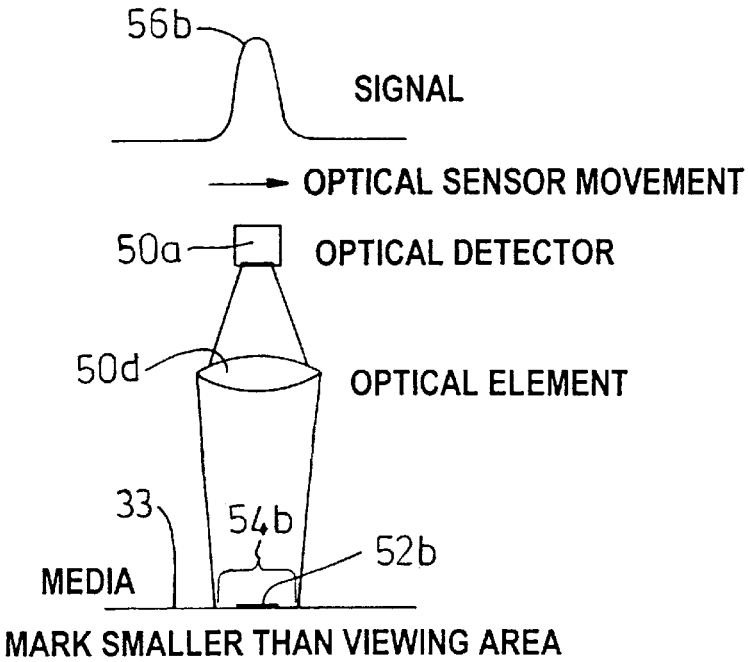
Figure 7C:
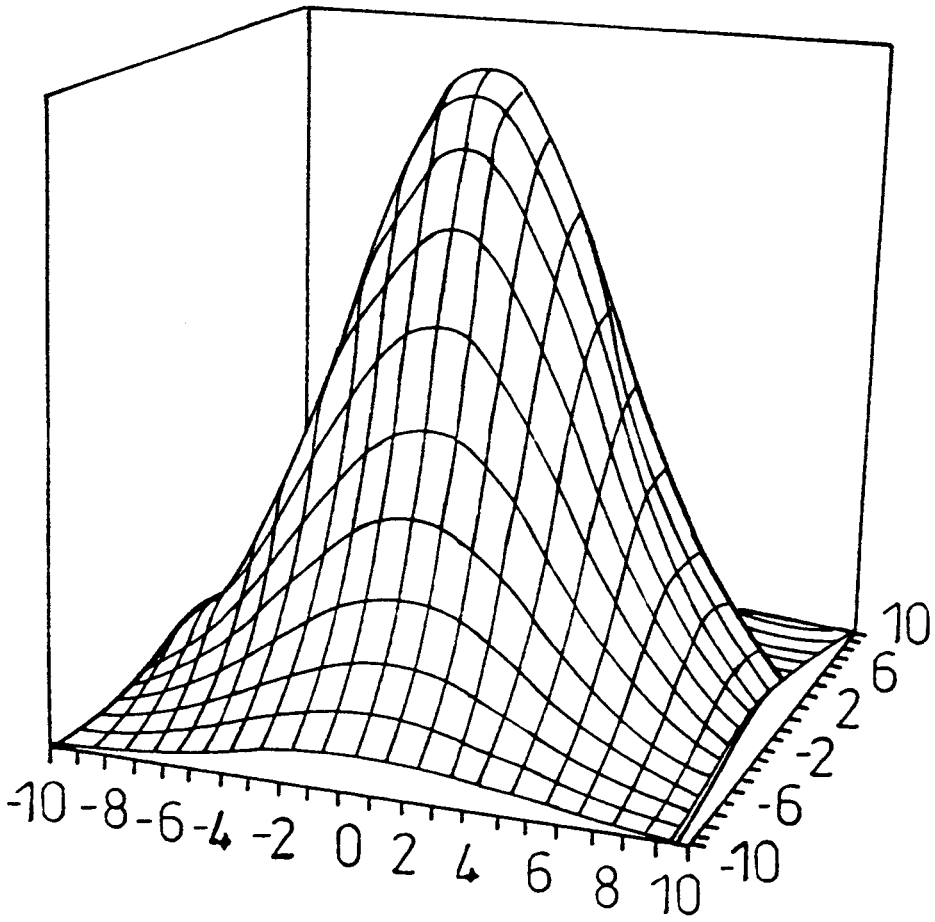
FIG. 7*c* illustrates the spatial response of the sensor of FIG. 6.

FIG. 7*c* illustrates the spatial response of the sensor, determined by mapping the PSF along all the points of the space to be analysed, here the space along the media plane. The values of the coordinates in FIG. 7*c* for this example are in space coordinates of $1/1200$ inch.

The sensor signal 56*a* output by the optical detector when the sensor is scanning across the mark 52*a* on the media is the mathematical convolution of the reflectivity of the mark 52*a* and the spatial response of the optical sensor.

If the nominal size of the mark to be detected is similar to or larger than the optical sensor viewing area, as indicated in FIG. 7*a*, the optical sensor signal is dominated by the shape of the mark. Thus, the resulting sensor signal 56*a* has a plateau in the maximum of the signal. The plateau adds inaccuracies in determining the position of the centre of the mark. Furthermore, non-uniformities in the marks on the medium can produce lack of consistency of the plateau, introducing erroneous centre position signals.

However, if the size of the mark to be detected is smaller than the sensor viewing area, the sensor signal is dominated by the response curve of the optical sensor. This is illustrated in FIG. 7*b*, where the size of the mark 52*b* is smaller than the size of the viewing area 54*b* of the sensor. This produces a corresponding sensor signal 56*b*, with a clear and relatively sharp peak. Therefore, in the present embodiment, it is desirable that the marks or lines to be detected are sized smaller than the sensor viewing area dimension in the direction in which the measurement is to be made. In this example, the application need only know the position along the scan axis at which the centres of the marks are detected. Thus, the dimension of the marks or lines can be made larger than the viewing area in the media axis direction, but preferably are smaller than the viewing area dimension in the scan axis direction.

Good results are typically obtained with a mark size between about 0.5 and 0.75 of the sensor viewing area dimension. Of course, the smaller the mark in relation to the sensor viewing area, the higher the resolution but at the expense of signal strength. In other words, when the marks are made smaller than the viewing area of the optical sensor, there is not a lower limit on the size of the mark, and the designer is guided by the necessity of having a minimum sensor signal to measure correctly. If the mark is very dark, a smaller mark can be used, while obtaining better resolution. In practice, the applicant has found that the measurement resolution of this type of optical sensor may be up to 4 microns. This provides a significantly greater resolution than the resolution or nozzle spacing of an exemplary printer, which has a dot spacing of 1/1200 inches, which equates to a resolution of approximately 20 microns.

Thus, if the optical sensor can be modelled like a first order OTF (corresponding to a normal curve), and the size of the mark is smaller than the sensor viewing area, the position of the mark on the media can be calculated with the precision of the mechanical scanning system of the optical sensor. This system provides an effective technique to find the centre of the mark because the signal has a clear and sharp peak corresponding to the centre.

Figure 8A:
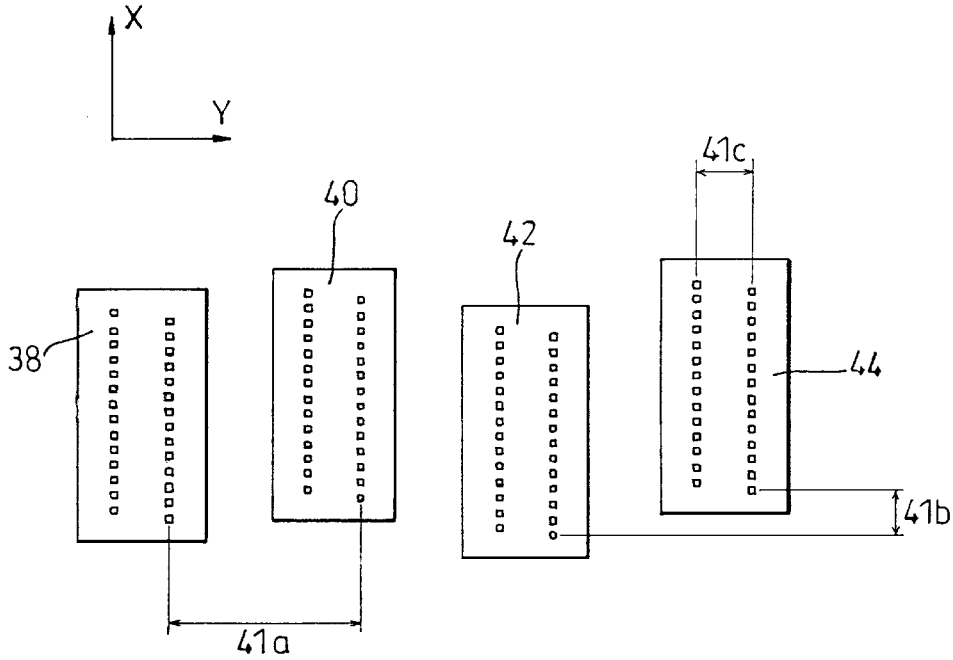
FIG. 8*a* illustrates a schematic plan view of the printheads mounted in the printer carriage assembly of the printer of FIG. 3 showing the offset between printheads in the media feed direction.

Referring now to FIG. 8*a*, a schematic plan view of the nozzle plates of each of printheads 38, 40, 42 and 44 as mounted in the printer carriage assembly 30 is shown. As can be seen from the figure, each printhead has two columns of nozzles with a column offset 41*c*. Furthermore, each printhead is separated from adjacent printheads in the Y-axis or scan axis direction by a Y-axis offset 41*a*. Due to inaccuracies in the location of each printhead in the printer carriage 30, each printhead is located slightly differently along the X-axis or in the media feed direction, giving rise to vertical printhead misalignments. By comparing the relative positions along the X-axis of corresponding nozzles between two printheads, while they remain on the carriage, it is possible to determine an actual offset 41*b* between those printheads along the media axis 13.

Method of the First Embodiment

The printhead alignment method of the present embodiment is generally performed when a printhead is replaced, when the relative offsets of one or more of the printheads in the media axis (X-axis) are likely to change. This may be done either immediately on replacing a printhead, or, when the printer is powered up and the new printhead is detected. However, the method of the present embodiment may also be manually triggered by a user using the user interface 20 of the printer, at such a time as is determined by the user. This may be done, for example, after a printhead crash has occurred; i.e. when one or more printheads have come into contact with the print medium and possible been moved relative to the printer carriage assembly 30. Alternatively, the printer may be programmed to implement the method of the present embodiment at periodic intervals; for example, after a predetermined period of time or after a predetermined amount of use.

When the method is implemented, the printer carriage assembly is brought to the right hand end of the scan axis, as is shown in FIGS. 3 and 4; i.e. adjacent the right hand drive mechanism enclosure 18. The media positioning system 35 of the printer 10 then feeds the media 33 currently in the printer forwards, if required, so that the method may be carried out using clean print media.

The printer carriage assembly 30 is then controlled by the printer control unit of the printer (not shown) to traverse the print media 33 along the scan axis 15 as in a normal printing mode. As the printer carriage assembly 30 traverses the print media 33, each of the four printheads, in sequence, prints an alignment pattern on the print media 33 under the control of the printer control unit. Each alignment pattern is printed using all of the nozzles in the printhead. Thus, each alignment pattern has substantially the same alignment characteristics as the printhead that printed it, whilst it is mounted in the carriage assembly 30. Furthermore, the height of each alignment pattern is therefore the same as the height of the columns of nozzles of the printhead in the media movement direction (X-axis); otherwise known as the "swath height" of the printhead. Thus, any offset in the media axis of a given printhead will be reflected in the position of the alignment pattern in the media axis on the print medium.

Figure 9A:
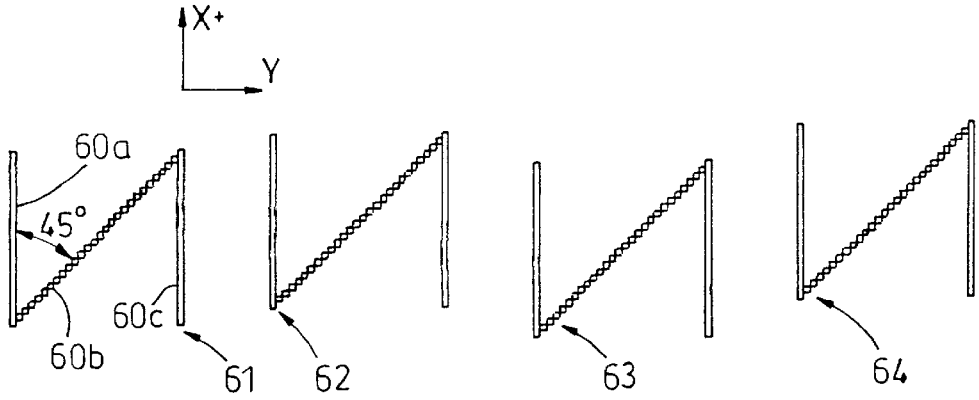
FIG. 9*a* illustrates printhead alignment patterns in accordance with the first embodiment of the present invention.

FIG. 9*a* illustrates the four alignment patterns 61–64, which respectively represent the black, cyan, magenta and yellow alignment patterns printed by the printheads 61–64, respectively.

As can be seen from the figure, in the present embodiment the alignment patterns are identical, differing only in their placement on the print medium 33. As can also be seen from the figure, each alignment pattern consists of three straight lines 60*a*, 60*b* and 60*c* (labeled only on alignment pattern 61 in the figure). Two of the lines 60*a* and 60*c* are parallel to the media axis (X-axis) and are positioned level with each other along the media axis. The third line 60*b* joins one end of the line 60*a* and the opposing end of the line 60*c* so as to form a line at 45 degrees to both the media axis (X-axis) 13 and the scan axis (Y-axis) 15. For the purposes of the present embodiment, the direction of the slope of the line 60*c* may be varied. Thus, instead of sloping upwards from left to right as is shown in the figure, the line 60*b* could instead slope downwards from left to right in the figure.

Each of the alignment patterns is printed at a predetermined location along the scan axis 15, as measured by the carriage positioning mechanism 31 in conjunction with the processor on the circuit board 36 of the carriage assembly 30. In this manner, it is ensured that no two alignment patterns overlap. This means that it is easier to distinguish one alignment pattern from another when determining their positions on the print medium. However, the skilled reader will appreciate that at least partially overlapping alignment patterns may additionally or instead be used.

FIG. 9*a* also schematically illustrates that each of the alignment patterns is positioned slightly differently along the media or X-axis, due to the vertical misalignments of the printheads 38, 40, 42 and 44, as is illustrated in FIG. 8. As is the case in FIG. 8, these misalignments have been exaggerated in FIG. 9 for the sake of clarity.

Due to the relative positions in the printer carriage assembly 30 of the optical sensor unit 50 and the printheads 38, 40, 42 and 44, the optical sensor unit 50 passes over the alignment patterns 61–64 shortly after they are printed; i.e. in the same pass of the printer carriage assembly 30 over the print media 33 in which the alignment patterns are printed. Thus, the skilled reader will understand that in the present embodiment the print media 33 remains stationary between the step of printing the alignment patterns and subsequently sensing the positions of the alignment patterns with the optical sensor unit 50.

Figure 9B:
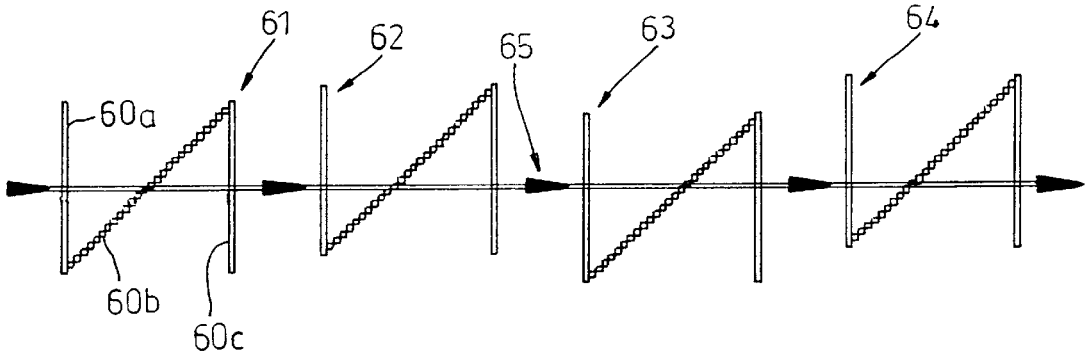
FIG. 9*b* illustrates the path of the optical sensor as it passed over the printhead alignment patterns of FIG. 9*a;*

FIG. 9*b* illustrates the path 65 of the optical sensor unit 50 superimposed over the alignment patterns 61–64. The direction of movement of the optical sensor unit 50 is shown by the arrows in the figure.

As has been explained above with respect to the optical sensor unit 50, where the optical sensor unit 50 passes over printed marks, the signal output by the optical detector 50*a* decreases in response to the reduced levels of reflectivity of the printed marks relative to the surrounding print medium 33.

Figure 9C:
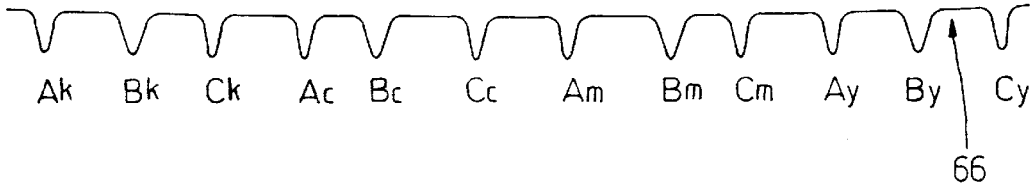
FIG. 9*c* illustrates the changing output of the optical sensor as it detects marks making up the printhead alignment patterns shown in FIG. 9*a* and 9*b;*

FIG. 9*c* illustrates the signal 66 output by the optical detector 50*a* as it detects those portions of the alignment patterns 61–64 lying beneath the optical sensor unit path 65 shown in FIG. 9*b*. As can be seen from FIG. 9*c*, the optical detector 50*a* outputs a narrow pulse as it passes over each line 60*a–c* of each of the alignment patterns 61–64. As has been explained above, the peak value of each pulse corresponds to the detection of the centre of each corresponding line.

Thus, for each alignment pattern 61–64 the optical detector 50*a* outputs three detection pulses; A, B and C that correspond to the detection of lines 60*a*, 60*b* and 60*c*, respectively. In FIG. 9*c*, these detection pulses are labelled: $A_k$, $B_k$ and $C_k$ in respect of the black (k) alignment pattern 61; $A_c$, $B_c$ and $C_c$ in respect of the cyan (c) alignment pattern 62; $A_m$, $B_m$ and $C_m$ in respect of the magenta (m) alignment pattern 63; and, $A_y$, $B_y$ and $C_y$ in respect of the yellow (y) alignment pattern 64.

As has been explained above with respect to FIG. 4, the instantaneous position of the printer carriage assembly 30, as it passes along the scan axis (Y-axis) is known. Consequently, the position of the optical sensor unit 50, which is mounted with a known offset to the printer carriage assembly 30, is also known at the moment that the central, or peak value for each detection pulse occurs, as is shown in FIG. 9*c*.

As the optical sensor unit 50 passes over each alignment pattern, the printer control unit records the instantaneous positions of the optical sensor unit 50 when the peak value of each of the detection pulses A–C is output. These positions correspond to the positions along the scan axis at which the three lines 60*a–c* are intersected by the path 65 of the optical sensor unit 50.

Figure 9D:
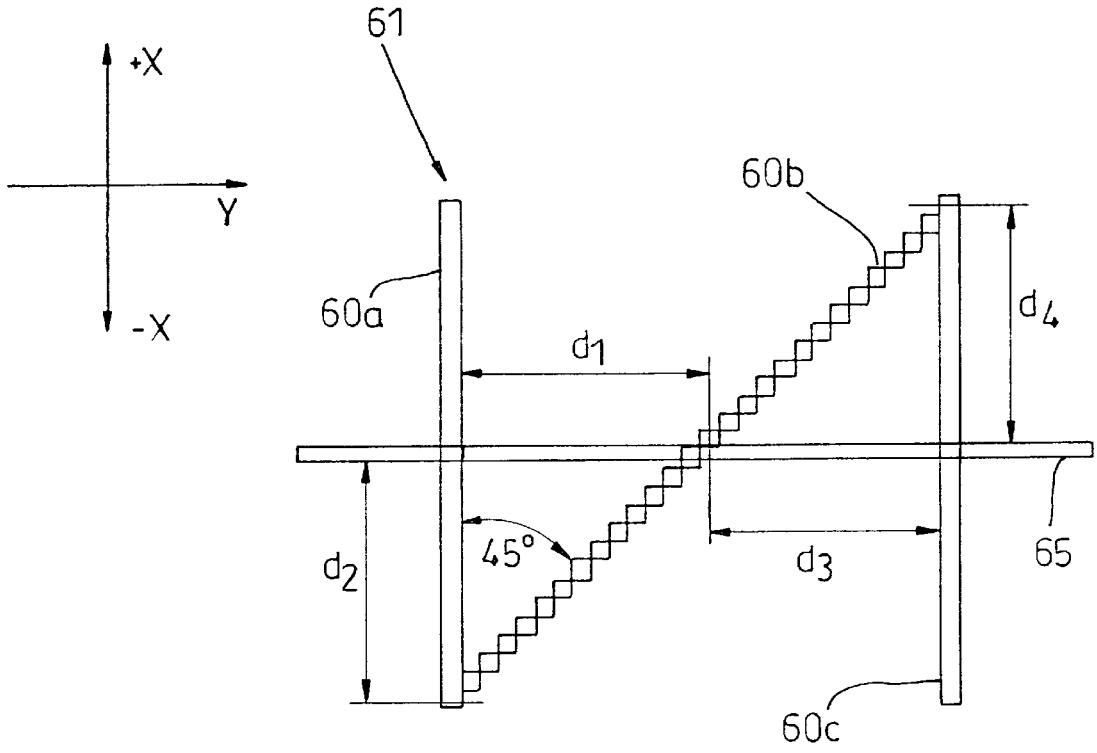
FIG. 9*d* shows an enlarged view of a printhead alignment pattern shown in FIG. 9*a;*

In the case of each alignment pattern, the recorded position along the scan axis of the optical sensor unit 50 at the moment that the first line 60*a* is detected is subtracted from the position along the scan axis of the optical sensor unit 50 at which the second line 60*b* is detected. This yields the separation "$d_1$" between the points at which the optical sensor unit path 65 crosses the first and second lines 60*a* and 60*b*. This is shown in FIG. 9*d*, which illustrates an enlarged view of the alignment pattern 61 together with the overlying path 65 of the optical sensor unit as shown in FIG. 9*b*.

Since the second line 60*b* lies at 45 degrees to the media movement direction (X-axis), the separation "$d_1$" is also equal to the distance "$d_2$" (also shown in FIG. 9*d*) between the point at which the optical sensor unit path 65 crosses the line 60*a* and furthest point of the line 60*a* in the direction of the negative media feed direction (X-axis) as shown in the figure. Therefore, the distance "$d_1$" indicates the length of the line 60*a*, and indeed the alignment pattern 61 as a whole, which extends beyond the optical sensor unit path 65 in the negative media feed direction (negative X-axis). As has been stated above, the length of the line 60*a* is known. In this embodiment, it is equal to the swath height of the printhead that printed the alignment pattern 61. Therefore, the length of the line 60*a*, and thus the alignment pattern 61 as a whole, which extends beyond the optical sensor unit path 65 in the positive media feed direction (positive X-axis) is given by:

$$\text{swath height}-d_1$$

The offset $O_b$ of the black alignment pattern 61 (i.e. the distance by which the centre of the alignment pattern 61 is displaced from the centre of the optical sensor unit path 65) in the media feed direction (X-axis) relative to the optical sensor unit path 65 may be given as an absolute distance by:

$$O_b=(\text{swath height}/2)-d_1$$

where a positive value offset indicates that the offset is in the positive media direction (X-axis) and a negative value offset indicates that the offset in the negative media direction (X-axis).

The skilled reader will appreciate that the relative offset of the alignment pattern may also be calculated, in the same manner as described above, using the distance "$d_3$", shown in the figure, which separates the points at which the optical sensor unit path 65 crosses the second and third lines 60*b* and 60*c*.

Due to the 45 degree relationship between the lines 60*b* and 60*c*, the separation "$d_3$" is also equal to the distance "$d_4$" (also shown in FIG. 9*d*) between the point at which the optical sensor unit path 65 crosses the line 60*c* and furthest point of the line 60*c* in the direction of the positive media feed direction (X-axis) as shown in the figure.

Thus, using the same method described above using the measurement "$d_1$", the offset of the alignment pattern 61 in the media feed direction (X-axis) relative to the optical sensor unit path 65 may also be given as an absolute distance by:

$$O_b=d_3-(\text{swath height}/2)$$

where similarly a positive value offset indicates that the offset is in the positive media feed direction (X-axis) and a negative value offset indicates that the offset in the negative media feed direction (X-axis).

The skilled reader will appreciate that the offset in the media feed direction (X-axis) for each alignment pattern may be measured using either or both of the values "$d_1$" and "$d_3$". By using both values a check may be introduced into the procedure, in that if the calculated offsets are not equal using both measurements, then it may be concluded that an error has occurred and that the routine should be performed again.

The offsets $O_c$, $O_m$ and $O_y$ in the media feed direction (X-axis) are then calculated in the same manner for the cyan, magenta and yellow patterns 62–64, respectively.

Once this has been done, the relative offsets in the media feed direction (X-axis) each of the printheads relative to one another are calculated. In the present embodiment, this is achieved in the following manner. The offset of each printhead $O_b$, $O_c$, $O_m$ and $O_y$ is subtracted from the offset $O_b$ of the black ink printhead 38. Thus;

Relative offset black$=O_b-O_b=O$

Relative offset cyan$=O_b-O_c$

Relative offset magenta$=O_b-O_m$

Relative offset yellow$=O_b-O_y$

Thus, the relative offsets for the cyan, magenta and yellow patterns are determined relative to the black pattern, which is deemed to have a zero relative offset. Once the relative offsets in the media feed direction have been determined for each printhead, this information is used by the printer control unit in order to correct for any misalignment that there might be between the printheads in the media feed direction. If there is a misalignment, the print output of the different printheads are then aligned in the media feed direction in the same manner as described above with respect to the prior systems; i.e. by excluding from use nozzles in each printhead that extend in the media feed direction beyond the nozzles of the other printheads and by resetting the "logical zero" in terms of the nozzles' numbering.

Figure 8B:
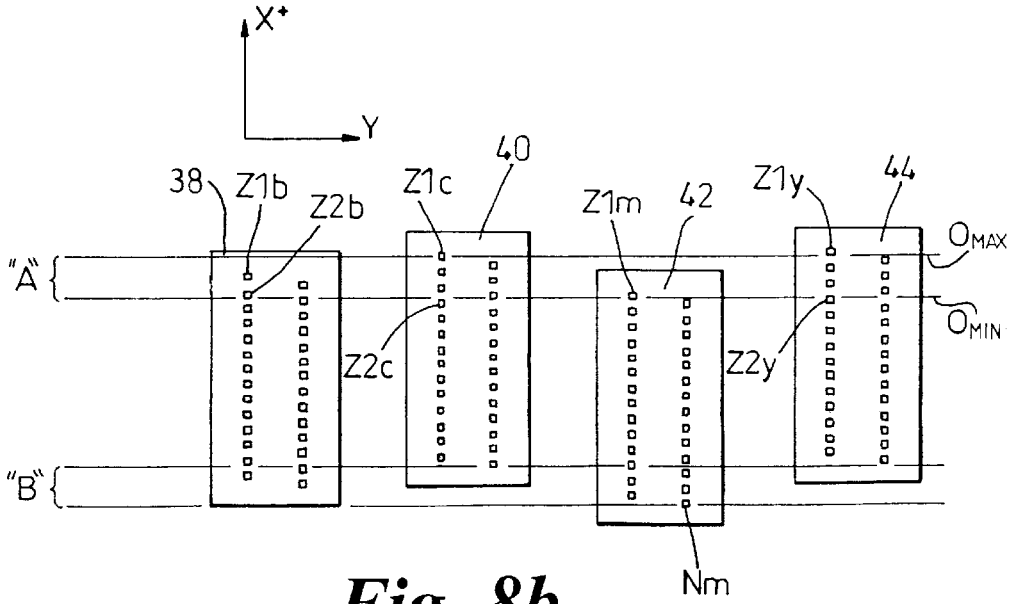

This is schematically illustrated in FIG. 8*b*, in which the minimum value $O_{min}$ and the maximum value $O_{max}$ of the calculated relative offsets are marked relative to the logical zero nozzle $Z_{1b}$ of the black printhead 38. By "logical zero", it is meant the nozzle of the black printhead in the most advanced point in the X axis (positive direction as shown in the figure), which is referenced by the number 0 in printing commands sent to the printhead). The values $O_{min}$ and $O_{max}$ define between them a band "A" across which not all of the printheads 38, 40, 42 and 44 have nozzles, as a result of their relative offsets in the X-axis. The nozzles in each printhead that fall in this band are accordingly not used in printing operations in order to ensure that the print output of each printhead is correctly registered with that of the remaining printheads in the X-axis.

As is shown in the figure, the black, cyan and yellow printheads 38, 40 and 44 have nozzles that fall into this band, including their original logical zero nozzles: $Z_{1b}$, $Z_{1c}$ and $Z_{1y}$, respectively. Thus, in the case of each of these printheads a new logical zero nozzle is created which lies approximately at the offset defined by $O_{min}$ These are $Z_{2b}$, $Z_{2c}$ and $Z_{2y}$, respectively. The remaining nozzles are then sequentially renumbered in a manner known in the art. By contrast, the original logical zero nozzle $Z_{1m}$ lies on the line $O_{min}$. Thus, this nozzles of the printhead 42 are not renumbered.

The same process of excluding nozzles from use is also applied to the other end of the printheads. This may be done by creating an exclusion band "B", of the same width as band "A" and extending from the nozzle in the lowest position in the X-axis, labelled $N_m$ of printhead 42, in the direction of the positive X-axis. Thus, once the nozzles lying in band "B" have been excluded from use, the number of working nozzles in each printhead is substantially the same and arranged so that the swath position of each printhead is coincident with the others, thus ensuring improved print registration between the printheads.

Second Embodiment

The second embodiment generally fulfills the same functions as described with respect to the first embodiment. However, the second embodiment is arranged to compensate for certain position measurement errors which might be incurred in the process of scanning the printed test marks, due to the material properties and positioning of the print media upon which the test marks are printed.

An example of a phenomenon which may cause a position measurement error to arise in the process of scanning the test patterns is "cockle". Cockle is the term used to describe the wrinkling of the print medium which has expanded due to absorbing liquid from the ink. If the print medium in the region in which the test patterns are printed is cockled, certain regions of the test patterns will be located closer to the optical sensor unit 50 than would be the case if the print media were to lie flat in the media plane; i.e. the pen to paper spacing will vary across the test pattern. Due to the relative orientations of the optical detector 50*a* and the light sources 50*e*, 50*f*, this change in distance may cause an error in the measurement of position of the test pattern along the path of the optical sensor unit 65. A similar problem may arise in certain printers in which the surface which supports the print media whilst being printed on is not flat. For example, in some printers, this surface is formed from a series of ribs arranged in the media feed direction. Thus, in such printers, the ribs cause the print media to lie in an undulating manner across the scan axis. This may cause the same type of error in measuring the position of the test patterns along the path of the optical sensor unit as if the print media were cockled.

A further example of a phenomenon which may cause a position measurement error to arise in the process of scanning the test patterns is skewed print media, which may arise if the print media is fed or otherwise moved in between the steps of printing the test patterns and subsequently scanning the test patterns. Frequently, the process of feeding print media in an incremental printer causes the print media to move in a "snake-like" motion as it is skewed repeatedly from side to side. The skewing of the test patterns (i.e. rotating the test patterns slightly about the axis perpendicular to the media plane) prior to being scanned, introduces a direct error into the measurement of the relative offsets between the printheads in the media feed direction. This type of error may arise, in particular, in printers in which the optical sensor is located away from (for example downstream) of the printzone; thus necessitating a media feed operation between printing and scanning the test patterns.

Therefore, the second embodiment is arranged to compensate for such errors in order to ensure that the relative offsets between the printheads in the media feed direction may be accurately measured and then compensated for.

The second embodiment employs similar apparatus and methods to that described with respect to the first embodiment, thus corresponding apparatus and method steps will not be described further in detail.

Figure 10A:
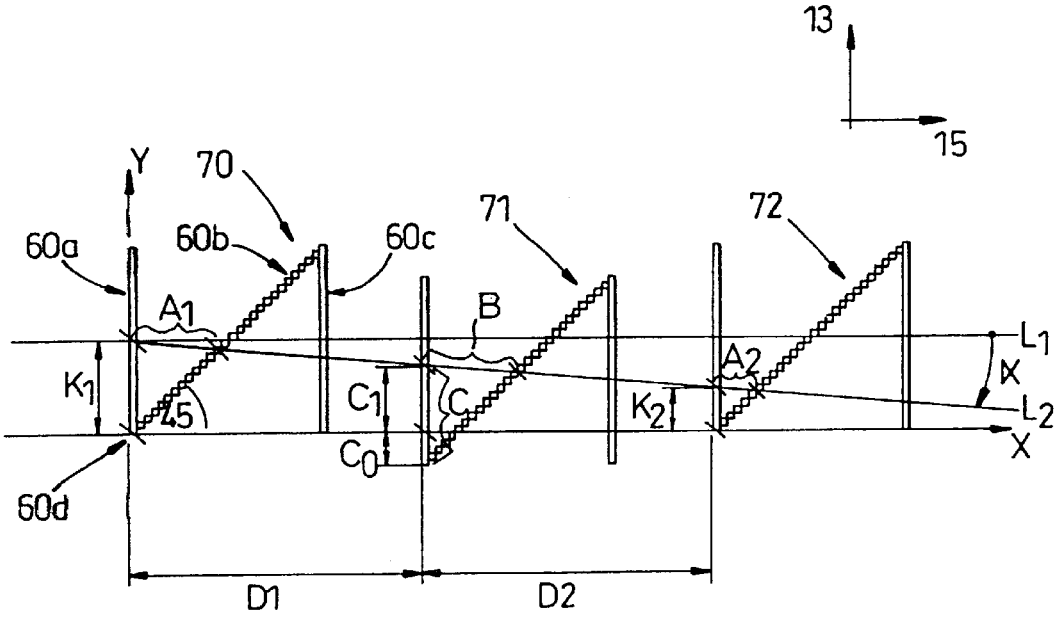
FIG. 10*a* illustrates printhead alignment patterns in accordance with a second embodiment of the present invention and 10*b* illustrates an enlarged schematic view of one of the printhead alignment patterns shown in FIG. 10*a; and,*
Figure 10B:
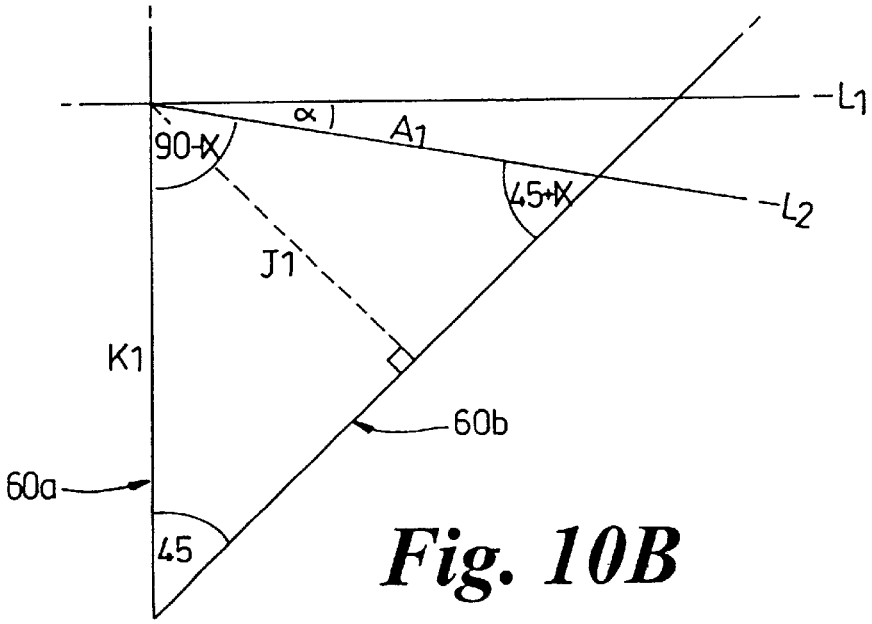

Referring to FIGS. 10*a* and 10*b*, the method of the second embodiment will now be described. Features in FIGS. 10*a* and 10*b* which correspond to features described in the first embodiment are referenced with corresponding numerals.

As was described in the first embodiment, the printer carriage assembly 30 is controlled by the printer control unit of the printer to traverse the print media 33 along the scan axis 15 as in a normal printing mode. As the printer carriage assembly 30 traverses the print media 33, three test patterns 70, 71 and 72 are printed. These are shown in FIG. 10*a*. The first and third test patterns 70 and 72 are printed by a single reference printhead; in this example this is the black printhead 38. The second test pattern 71 is printed by a different printhead, the offset in the media feed direction of which is to be measured relative to the reference printhead; in this example the measured printhead is the cyan printhead 42. As can be seen from the figure, the second test pattern 71 is printed between the reference test patterns 70 and 72 in the direction of the scan axis.

These test patterns each have the same form as those described with reference to the first embodiment. Thus, the alignment patterns 70, 71 and 72 are identical, differing only in their placement on the print medium 33. Further, they each consists of three straight lines: lines 60*a* and 60*c* lying parallel to the media axis 13 and being positioned level with each other along the media axis; the line 60*b* joining one end of the line 60*a* and the opposing end of the line 60*c* so as to form a line at 45 degrees to both the media axis 13 and the scan axis 15. Again each test pattern 70, 71 and 72 is printed using all of the nozzles in the printhead and is printed at a predetermined location along the scan axis 15. The relative positions of the test patterns 70, 71 and 72 along the scan axis 15 are indicated by distances D1 and D2 in the figure.

As can be seen from the figure the test patterns 70 and 72 being printed by the same printhead are printed level with each other in the media axis 13. The test pattern 71, which is printed by a different printhead is illustrated as having an offset in the media feed direction relative to the other test patterns 70, 72. The offset is illustrated in the figure by distance $C_0$. The offset $C_0$ has been exaggerated in FIG. 10*a* for the purposes of clarity.

Once the test patterns have been printed they are scanned in the same manner as described in the first embodiment.

However, this may be done either in the same pass of the printer carriage over the print medium as the printing of the test patterns, or in a subsequent pass. Thus, the optical detector 50*a* outputs detection pulses corresponding to detection of each of the lines 60*a–c* of each of the three test patterns 70–72, which are used to determine the positions of the test patterns in the media feed direction, as is described below.

FIG. 10*a* illustrates the "apparent" path of the optical sensor unit 50 when it scans the test patterns 70–72, superimposed over the test patterns 70–72. The "apparent" path of the optical sensor unit 50 is illustrated by the line $L_2$. As can be seen from the figure, the line $L_2$ lies at an angle $\alpha$ to the direction of the scan axis relative to the print media when the test patterns 70–72 were printed, which is represented by the line $L_1$. FIG. 10*a* also illustrates the distance for each test pattern between its vertex 60*d* (referenced only in the case of the test pattern 70) and the point on its line 60*a* which is intersected by the line $L_2$. These distances are $K_1$, C and $K_2$ for test patterns 70, 71 and 72, respectively. The figure further illustrates the distances between the points on lines 60*a* and 60*b* intersected by the line $L_2$, for each test pattern. These distances are $A_1$, B and $A_2$, for test patterns 70, 71 and 72, respectively.

For the sake of convenience in demonstrating the calculation of the offset distance $C_0$, only, X and Y axes have been included in the FIG. 10*a*. The X axis is parallel to the line $L_1$ and arranged such that the vertices 60*d* of both test patterns 70 and 72 lie on the X axis. The Y axis is positioned to be co-linear with the line 60*a* of the test pattern 70.

FIG. 10*a* also illustrates the distance $C_1$ between the X axis in the figure and the point on line 60*a* of test pattern 71 intersected by the line $L_2$.

As has been described above, there are various reasons why position measurement errors might be incurred in the process of scanning the printed test marks. In the case of a varying pen to paper spacing across the scan axis 15, the skilled reader will appreciate that the "actual" path of the optical sensor unit 50 may be parallel to the direction of the scan axis relative to the print media when the test patterns 70–72 were printed; i.e. the line $L_1$. However, the varying pen to paper spacing may introduce errors into the measured distances lying between the different lines 60*a–c* of the different test patterns 70–72; thus, giving the impression of a deviation from the "actual" path of the optical sensor unit 50, which corresponds to the "apparent" path $L_2$.

The skilled reader will appreciate that the FIG. 10*a* represents only a small proportion of the distance along the scan axis 15 of the printer. Thus, in practice, where the pen to paper spacing changes over the length of the scan axis, the angular divergence of "apparent" path $L_2$ of the optical sensor unit, relative to the line Li will vary in dependence on the position along the scan axis. Thus, in practice, the line $L_2$ may trace a sinusoidal path varying about the line $L_1$ in the positive and negative media feed axis 13 relative to the line $L_1$.

However, where the print media on which the test patterns are printed is skewed between being printed and scanned, the line $L_2$ may represent the actual path of the optical sensor unit 50 as it scans the test patterns 70–72. In this case, the angle $\alpha$ represents the angle by which the print media is skewed, for example, through a sheet feed operation.

The skilled reader will of course appreciate that in certain circumstances both types of error may be simultaneously present.

The processor of the printer determines the distances $A_1$, B and $A_2$, separating the points at which the "apparent" path $L_2$ crosses the lines 60*a* and 60*b* in test patterns 70, 71 and 72, respectively. This may be achieved in the same manner that the separation "$d_1$" was determined in the first embodiment.

The processor of the printer then determines the offset $C_0$ between the cyan test pattern 71 and the black test patterns 70 and 72 in the media feed direction in the following manner.

The equation to the straight line represented by $L_2$ may be given by the equation:

$$Y=aX+b$$

The equation has boundary conditions: when X=O, $Y=K_1$; so, $b=K_1$; and, when×=D1+D2, $Y=K_2$.

Therefore:

$$a(D_1+D_2)+b=K_2;\ \text{and,}$$

$$a=\frac{K_2-K_1}{D_1+D_2};\ \text{and,}$$

$$Y=\frac{K_2-K_1}{D_1+D_2}*X+K_1$$

When X=D1, $Y=C_1$, therefore:

$$C_1=\frac{K_2-K_1}{D_1+D_2}*D_1+K_1$$

The offset distance $C_0$ is equal to the C—$C_1$, therefore:

$$C_0=C-\left[\frac{K_2-K_1}{D_1+D_2}*D_1+K_1\right]$$

Referring to FIG. 10*b*, an enlarged trigonometric representation of part of the test pattern 70 is shown. The figure illustrates the lines $L_1$ and $L_2$, the angle $\alpha$. As can be seen from the figure, the distances and the directions of $K_1$ and $A_1$ are shown. Using trigonometry, the dotted line J1 is equal to:

$$J1=K,\ \sin(45);\ \text{and,}\ J1=A_1\ \sin(45+\alpha)$$

Therefore:

$$K_1=A_1*\frac{\sin(45+\alpha)}{\sin(45)}$$

By analogy:

$$C=B*\frac{\sin(45+\alpha)}{\sin(45)};\ \text{and,}$$

$$K_2=A_2*\frac{\sin(45+\alpha)}{\sin(45)}$$

In practice, it has been found that the size of the angle a is very small.

Thus, as a tends to zero, $K_1=A_1$, C=B and $K_2=A_2$. The offset distance $C_0$ is then given by:

$$C_0=B-\left[\frac{A_2-A_1}{D_1+D_2}*D_1+K_1\right]$$

The skilled reader will however appreciate that the present embodiment may also be applied to situations where the angle a is not considered small. In such a situation, the required variables may be calculated using conventional numerical methods. In the present embodiment distance D1 is made equal to distance D2. Thus, the offset distance $C_0$ is given by:

$$C_0 = B - \left[\frac{A_1 + A_2}{2}\right]$$

Thus, in the present embodiment of the invention, the offset correction $C_O$ is determined by interpolating between the measured distances for the two reference test patterns 70 and 72. The offset distance $C_0$ is then calculated by the processor of the printer. The skilled reader will appreciate that in the case where the print media has been skewed, but does is not cockled or otherwise formed in order to cause a varying pen to paper spacing, a single measurement of offset $C_0$, may be sufficient to ensure a good corrective adjustment; thus ensuring good alignment in the media feed direction between the reference (black) printhead and the cyan printhead. In this case, the processor of the printer then implements the correction to the positioning of the cyan printhead 42 in the media feed direction. This may then be carried out in the same manner as described in the first embodiment. The offset distance relative to the black reference printhead is then determined in the same manner for each of the remaining printheads; thus ensuring that each printhead is satisfactorily aligned in the media feed direction with the reference printhead.

However, in the case where a variation in the pen to paper spacing is present across the scan axis, it will be appreciated it is preferable to carry out a number of measurements of the offset $C_0$ at varying positions across the scan axis. Each of these measurements may be carried out in the same manner as described above. In this manner, an average value of the offset of the printhead in question may be determined relative to the reference printhead at varying positions across the scan axis. Thus, the degree to which the offset is corrected may be selected such that it gives good printing results across the whole length of the scan axis along which the printing is carried out.

It will be understood that the greater the number of readings taken across the scan axis, the better will be the correction to the offset. However, the exact number of such measurements that need to be carried out will depend upon the frequency and magnitude of the pen to paper spacing variation as well as the required precision in correcting the offsets in the media feed direction between the printheads of the printer. These factors will vary depending upon the situation in which the method of the present embodiment is employed. However, this may be determined by experimentally.

In one preferred embodiment, a printhead under test prints a row consisting of numerous test patterns across the scan axis, which are alternated with test patterns printed by the reference printhead. The skilled reader will understand that in this manner, a given test pattern printed by the reference printhead may be used, for interpolation purposes, to establish the relative offset of test patterns printed on either side of it along the scan axis, by the printhead under test printed.

The skilled reader will also appreciate that the present embodiment need not be limited to calculating the relative offset of a given test pattern by using a straight line interpolating technique between two reference test patterns. Instead, for example, a conventional curve fitting technique could be used to fit a polynomial curve to the measurements of a number of reference test patterns; i.e. greater than two. In this manner, the measured offset of each test pattern printed by the printhead under test, could be established relative to co-ordinates of the fitted curve at the position along the scan axis corresponding to the position of that test pattern.

The offset distance relative to the black reference printhead may then be determined in the same manner for each of the remaining printheads; thus ensuring that each printhead is satisfactorily aligned in the media feed direction with the reference printhead.

Further Embodiments

In the above embodiments numerous specific details are set forth in order to provide a thorough understanding of the present invention. It will be apparent however, to one skilled in the art, that the present invention may be practiced without limitation to these specific details. In other instances, well known methods and structures have not been described in detail so as not to unnecessarily obscure the present invention.

For example, the skilled reader will appreciate that the present invention may be applied to devices other that ink jet printer such as, for example traditional plotters which utilise felt-tipped pens and the like. Similarly, although the above embodiment was described with reference to colour printing, the skilled reader will appreciate that the present invention is also applicable to monochrome printers. Furthermore, although the above embodiment was described with reference to a printer incorporating four printheads, the skilled reader will appreciate the present invention is also applicable printers that employ two, three or more than four printheads. Indeed, the invention may also be used to advantage with printers having only one printhead, should the exact placement in the direction of the media axis of the printed output need to be measured or controlled.

Figure 11A:
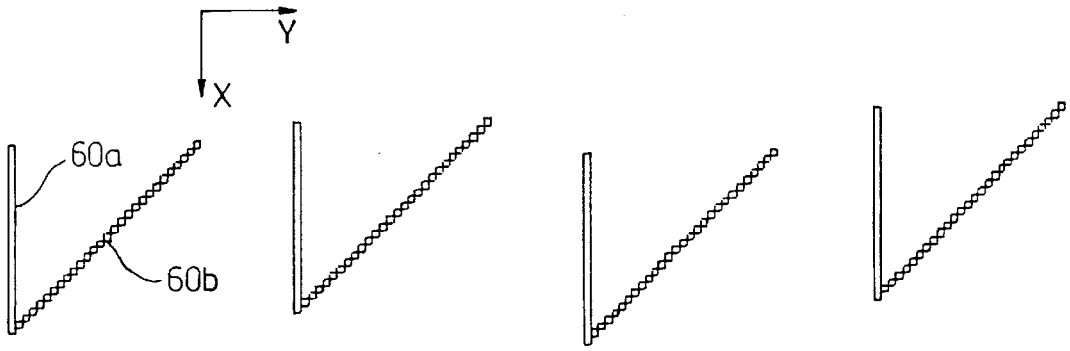
FIGS. 11*a–c* each illustrate alternative printhead alignment patterns in accordance with the present invention.

Additionally, the skilled reader will appreciate that the printhead test patterns may be varied in a variety of ways. For example, it will be clear to the skilled reader that the present invention may be implemented using a reduced number of lines parallel to the media axis (X-axis). For example, as is shown in FIG. 11*a* the invention may be implemented using printhead alignment patterns which have only one of lines 60*a* and 60*c*; in the case shown in the figure, only line 60*a*.

Figure 11B:
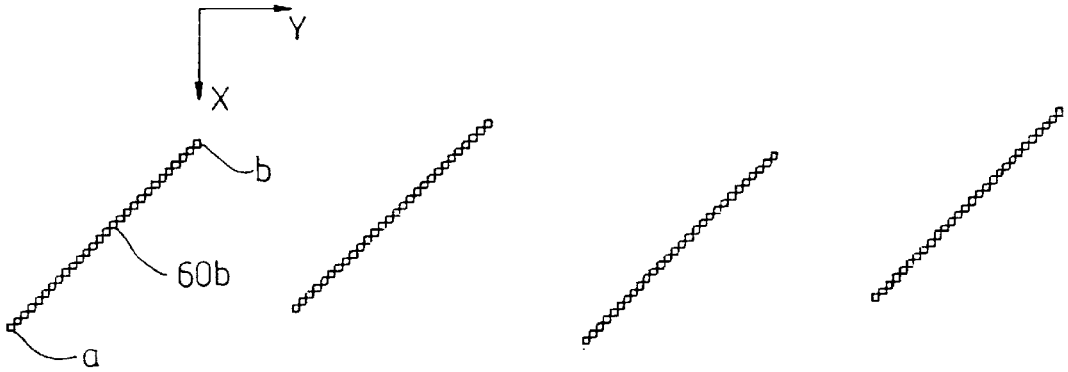

Furthermore, the skilled reader will appreciate that assuming that the position of printed output for each printhead is accurately known, in the direction of the scan axis, then both of the lines 60*a* and 60*c* may be dispensed with in the printhead alignment pattern. This is shown in FIG. 11*b*. In such an embodiment, the position measurement normally made by measuring the position of the line 60*a* along the scan axis may be replaced by the recorded position along the scan axis of a nozzle that printed a particular known point in the alignment pattern at the time that it was printed; for example one or other of the ends a or b of the line 60*b*, as shown in FIG. 11*b*.

Figure 11C:
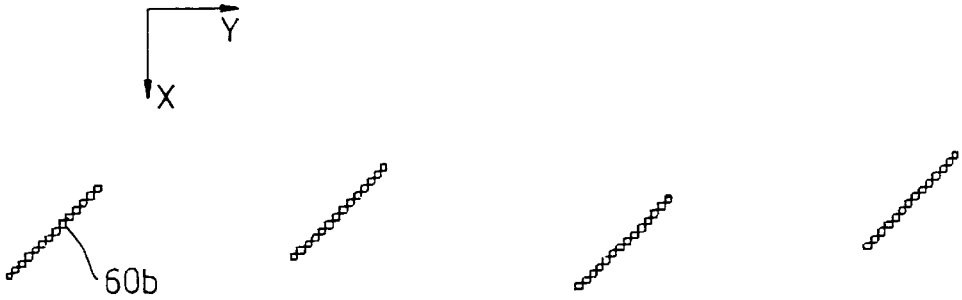

Additionally, although in the above embodiments each alignment pattern was printed using all of the nozzles in the printhead, the skilled person will appreciate that this need not be the case. For example, each alignment pattern may instead by printed using just selected nozzles of the printhead. For example half of the nozzles in one column could be used, as is shown in FIG. 11*c*. In this example, the nozzles located about the center of one column are used in order to allow the patterns to be centrally located with respect to the path of the optical sensor unit 50.

As can be seen from FIG. 11*c* this gives rise to smaller alignment patterns, which use less print media in the media direction and additionally used less ink. In such an embodiment, it is preferable that generally corresponding nozzles are used by each printhead to print the respective alignment patterns. In this manner, the alignment patterns may each be arranged to overlap the path of the optical scanner unit. Thus, the optical scanner may determine the position of each of the alignment patterns in one pass of the print media, without it being necessary to feed the print media in order to individually position each alignment pattern in order that it might be detected by the optical scanner.

Additionally, different alignment patterns may be used to implement the present invention.

For example the angle of 45 degrees of the line 60*b* joining the two lines 60*a* and 60*c* parallel to the media movement direction (X-axis) may be varied to a different known angle. As the skilled reader will appreciate, in the event that it is varied, there will no longer be a unitary relationship between the printhead offset in the media (X-axis) direction from the measurement made in the scan axis direction. However, the printhead offset in the media direction may in this case be determined by finding the measurement made in the scan axis direction in a look up table relating measurements made in the scan axis direction with printhead offset in the media direction. Alternatively, a simple trigonometric calculation may be preformed in order to determine the offset in the media movement direction (X-axis) direction from the measurement made in carriage movement direction (Y-axis).

A further example of a different alignment pattern which may be used in conjunction with the present invention may include a curved line or curved edge of a graphic instead of a straight line, such as 60*b* of the above embodiments, for determining the printhead offset in the media axis. In such an embodiment, provided the form of the curve is known, the offset of the pattern in the media direction may be determined from the measurement of the position of the pattern in scan axis. Again, the printhead offset in the media direction may be determined by finding the measurement made in the scan axis direction in a look up table relating measurements made in the scan axis direction with printhead offset in the media direction.

Although all of the alignment patterns in the embodiments described above were identical, the skilled reader will appreciate that this need not be the case in practice. Thus, in further embodiments of the invention, different alignment patterns may be used for different printheads.

Furthermore, the skilled reader will realise that the present invention may be implemented using a detector other than an optical detector in order to determine the position of aspects of the alignment patterns. Any suitable property of the mark which differentiates it from the medium upon which it is located may be used in order to determine its position. For example, if the substance, for example ink, which is used to make the mark has magnetic or conductive properties that may be used to differentiate it from the background media, the invention may be implemented using a sensor that detects the magnetic or conductive properties, instead of the optical properties of the marks.

The skilled reader will also realise that in the case of the first embodiment, the scanning step to detect the position of the alignment patterns need not be performed on the same pass of the carriage over the print media as that in which the alignment patterns are printed. In practice this could be implemented on any subsequent pass of the printer carriage over the print medium. However, if the scanning step is implemented on the return pass of the printer carriage or in any subsequent pass in the reverse direction, the order in which the pulses output by the optical detector as it passes over each line of each alignment pattern will be reversed.

Although in the above embodiments the process of reducing the offset in the media feed direction between printheads relies upon excluding certain nozzles from use and resetting the "logical zero" in terms of the nozzles' numbering, the skilled person will realise that the other methods may be used to implement the present invention. For example, once the relative offsets between the various printheads have been measured, it would be possible to correct these offsets using an electromechanical system to physically move the printheads into alignment along the media movement axis. This may be achieved for each printhead, for example, by using a piezo-electric actuator to move the printhead and a position sensor to detect the resultant change in position of the printhead.

What is claimed is:

1. A method of determining a registration offset in a hard copy apparatus, comprising the steps of:

marking an alignment pattern on a print medium with a first pen;

traversing said pattern in a first direction with a sensor and measuring the position of a portion of said pattern in said first direction; and, determining the offset of said pattern in a second direction, said pattern being configured such that said measured position in said first direction is indicative of a registration offset in said second direction.

2. A method according to claim 1, wherein the step of determining said pattern offset further comprises the step of referring to a look up table relating values of said measured position to offset distances or of carrying out a mathematical function on said measured position value to determine said pattern offset.

3. A method according to claim 1, wherein said pen and said sensor are each supported by a print carriage arranged traverse said medium in positive and negative directions along a scan axis, said scan axis being substantially parallel to said first direction.

4. A method according to claim 3, wherein said marking and measuring steps are implemented during a movement of said carriage in single direction along said scan axis.

5. A method according to claim 4, wherein said print medium is maintained stationary relative to said apparatus between said steps of marking and measuring said position of a portion of said pattern in said first direction.

6. A method according to claim 1, wherein said pattern comprises a plurality of points arranged to form a first line, said line lying at an oblique angle relative to said first direction.

7. A method according to claim 6, wherein said pattern further comprises a further plurality of points arranged to form a second line, said second line being orientated at an angle substantially perpendicular to said first direction and substantially separated from said first line in said first direction.

8. A method according to claim 7, wherein said step of measuring said position of a portion of said pattern comprises the step of measuring the distance along a path followed by said sensor between the points at which said first and said second lines are subtended by said sensor path.

9. A method according to claim 1, wherein the apparatus further comprises a further pen, wherein said method further comprises in respect said further pen the steps of:

marking a first further alignment pattern on said print medium;

traversing said first further pattern in a first direction with said sensor and measuring the position of a portion of said first further pattern in said first direction; and, determining the offset of said first further pattern in said second direction, said first further pattern being configured such that said measured position in said first direction is indicative of its registration offset in said second direction.

10. A method according to claim 9, further comprising the step of comparing said offset of the first pattern and said offset of the first further pattern.

11. A method according to claim 10, further comprising the steps of:

marking with said further pen a second further alignment pattern on said print medium spaced apart from said first further pattern along said scan axis;

repeating said measuring and determining steps of claim 9 in respect of said second further pattern, said second further pattern being configured to have a measured position in said first direction indicative of a registration offset in said second direction; and, comparing said offsets determined in respect of said first and second further patterns, to detect an error introduced into said registration offset.

12. A method according to claim 11, further including the step of determining the error in the measurement of said registration offset of said alignment pattern printed by said first pen by interpolating or extrapolating from said measured offsets of said first and second further alignment patterns to the position along said scan axis corresponding to the position of said alignment pattern printed by said first pen.

13. A method according to claim 12, further including the steps of:

printing a further one or more alignment patterns with said first pen extending substantially across said scan axis;

repeating said steps of determining said offset in said second direction and determining said error in the measurement of said offset for each of said one or more alignment patterns; and, determining an offset correction based on the set of said offset errors of said one or more alignment patterns.

14. A method according to claim 13, further including the steps of:

printing a further one or more further alignment patterns with said further pen interspersed with said one or more alignment patterns printed by said first pen;

and using said one or more further alignment patterns to establish the error in the offset measurement of said further one or more alignment patterns printed by said first pen.

15. A method according to claim 14, further including the steps of:

fitting a polynomial curve to three or more of said determined offsets corresponding to the first, second or further alignment patterns to increase the accuracy in determining said error in said offset of said alignment pattern printed by said first pen by interpolation or extrapolation.

16. A method according to claim 15, further comprising the step of adjusting said print output position of either said first or said further pen in dependence upon the relative offset of said first and further pens including any detected error in the offset measurement process.

17. A hard copy apparatus arranged to implement the method of claim 1.

18. A computer program comprising program code means for performing the method steps of claim 1 when said program is run on a computer and/or other processing means associated with suitable hard copy apparatus.

19. A method according to claim 11, wherein said hard copy apparatus is an inkjet apparatus, and said first and/or said further pen comprises a plurality of ink ejection nozzles.

20. A method according to claim 19, wherein the step of adjusting said print output position of at least one of said pens comprises the step of adjusting the position of one of said pens in said printer carriage or the step of excluding selected nozzles of the printhead from use.

21. A method of determining a misalignment in a printer device, said device comprising a pen arranged to mark a print medium and a sensor arranged to detect marks on said medium along a sensor path, said method comprising the steps of:

marking an alignment pattern on said medium, said pattern being at least partially located along said sensor path and being configured such that the position along said sensor path at which a predetermined portion of said pattern is located is indicative of a distance by which said pattern is offset from said sensor path in a direction substantially perpendicular to said sensor path; and, detecting said position along said sensor path of said predetermined portion.

* * * * *